US005146281A

United States Patent [19]

Kisu

[11] Patent Number: 5,146,281

[45] Date of Patent: Sep. 8, 1992

[54] IMAGE FORMING APPARATUS HAVING CHARGING MEANS

[75] Inventor: Hiroki Kisu, Ichikawa, Japan

[73] Assignee: Canon Kabushiki Kaisha, Tokyo, Japan

[21] Appl. No.: 580,469

[22] Filed: Sep. 11, 1990

[30] Foreign Application Priority Data

Sep. 14, 1989 [JP] Japan ..... 1-239562

[51] Int. Cl.[5] ..... G03G 15/02

[52] U.S. Cl. ..... 355/219; 346/160; 361/225

[58] Field of Search ..... 355/219; 361/225; 346/160, 160.1

[56] References Cited

U.S. PATENT DOCUMENTS 4,727,453 2/1988 Ewing ..... 361/225

4,851,960 7/1989 Nakamura et al. ..... 361/225

*Primary Examiner*—Joan H. Pendegrass

*Attorney, Agent, or Firm*—Fitzpatrick, Cella, Harper & Scinto

[57] ABSTRACT

An image forming apparatus for forming images comprises a movable image bearing member and charger for charging the image bearing member while it is moving. The charger includes a contact member contactable to the image bearing member and a voltage applicator for applying a vibratory voltage between the contact member and the image bearing member. A latent image former is provided for forming a latent image along a scanning line on the image bearing member charged by the charger whereby the latent image is developed and transferred onto a transfer material, wherein a frequency f of the vibratory voltage and a speed Vp of the movement of the image bearing member are so selected that an interval between adjacent scanning lines multiplied by N or 1/N does not fall within a variation range of a spatial wavelength λsp where λsp=Vp/f.

20 Claims, 8 Drawing Sheets

IMAGE FORMING APPARATUS HAVING CHARGING MEANS

FIELD OF THE INVENTION AND RELATED ART

The present invention relates to an image forming apparatus such as a laser beam printer, wherein an image bearing member is electrically charged by a charging member contacted to the image bearing member and supplied with a vibratory voltage, and the charged surface of the image bearing member is scanned line by line to be exposed to image information.

Contact charging is the charging in which a charging member supplied with a voltage is contacted to a member to be charged to apply electric charge to the member to be charged to a desired potential level. As compared with a widely used corona discharger, the voltage required for providing the potential level on the member to be charged is smaller; the quantity of ozone produced by the charging action is very small so that the ozone removing filter is not required, and the air discharging system is simplified; the maintenance operation is easy; and the structure is simple.

Because of these advantages, it is particularly noted as means which can replace the corona discharger to charge an image bearing member or other members to be charged such as a photosensitive member, a dielectric member or the like in an image forming apparatus such as an electrophotographic machine, copying machine, laser beam printer or an electrostatic recording machine.

U.S. Pat. No. 4,851,960 which has been assigned to the assignee of this application has proposed a contact charging method and device in which a vibratory voltage is applied to the contact charging member, which is contacted to the member to be charged to uniformly charge the member to be charged.

Referring first to FIG. 4, there is shown an example of the structure. A member 1 is to be charged, and is an electrophotographic photosensitive member or an electrostatic recording dielectric member, which will hereinafter be called simply "photosensitive drum", in the form of a drum rotatable at a predetermined peripheral speed (process speed) in a direction indicated by an arrow, for example.

A contact charging member 2 is in the form of a conductive roller (charging roller) and comprises a core metal **2*b* and conductive roller 2*a* therearound made of conductive rubber or the like. The charging roller 2 is press-contacted to the surface of the photosensitive drum with a predetermined pressure provided by urging springs 10 acting on the opposite end portions of the core metal 2*b*. The conductive roller rotates following rotation of the photosensitive drum 1**.

A voltage application source 9 applies a voltage to the charging roller 2 by way of a contact leaf spring 8 contacted to the core metal **2*b* of the charging roller 2. The voltage is a vibratory voltage (DC biased AC voltage) having a peak-to-peak voltage Vpp larger than twice a charge starting voltage relative to the photosensitive member. By the application of such a voltage, the outer peripheral surface of the photosensitive drum 1** is uniformly charged, while it is rotated.

The contact charging member is not limit to a roller configuration, but may be in the form of a blade, a rod, a block, a pad, a belt, a web, a brush or the like.

The image forming apparatus using the contact type charging means supplied with such a voltage so as to charge the image bearing member, involves the following problems.

FIG. 5 shows an example of horizontal line pattern image **11*a* formed on a recording sheet 11. When such a pattern is produced, the image may have interference stripes 11*b* if the spatial frequency by the frequency of the voltage source 9 to the contact charging member 2 becomes close to the intervals between the horizontal lines 11*a***.

The frequency of the voltage source 9 can vary ±10% from the rated frequency because of parts error. With some voltage source 9, the spatial frequency thereof is the same as the intervals between horizontal lines **11*a* with the result of remarkable interference stripes 11*b***.

SUMMARY OF THE INVENTION

Accordingly, it is a principal object of the present invention to provide an image forming apparatus capable of producing good images without or with suppressed interference fringes or stripes.

According to one aspect of the present invention, an image forming apparatus comprises a movable image bearing member and charging means for charging the image bearing member while it is moving. The charging means includes a contact member contactable to the image bearing member and voltage application means for applying a vibratory voltage between the contact member and the image bearing member. Latent image forming means are provided for forming a latent image along a scanning line on the image bearing member charged by the charging means whereby the latent image is developed and transferred onto a transfer material, wherein a frequency f of the vibratory voltage and a speed Vp of the movement of the image bearing member are so selected that an interval between adjacent scanning lines multiplied by N or 1/N does not fall within a variation range of a spatial wavelength $\lambda sp$ where $\lambda sp = Vp/f$.

According to another aspect of the present invention, an image forming apparatus comprises a movable image bearing member and charging means for charging the image bearing member. The charging means includes a contact member contactable to the image bearing member and voltage applying means for applying a vibratory voltage between the contact member and the image bearing member. Latent image forming means are provided for forming a latent image along a scanning line on the image bearing member charged by the charging means whereby the latent image is developed and transferred onto a transfer material, wherein a frequency f of the vibratory voltage and a speed Vp of the movement of said image bearing member are so selected that a variation range of a spatial wavelength $\lambda sp = Vp/f$ does not overlap the result of $(n+m)d$ multiplied by N or 1/N, where n is the number of scanned lines, m is the number of non-scanned lines, and d is a diameter of one dot of the image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
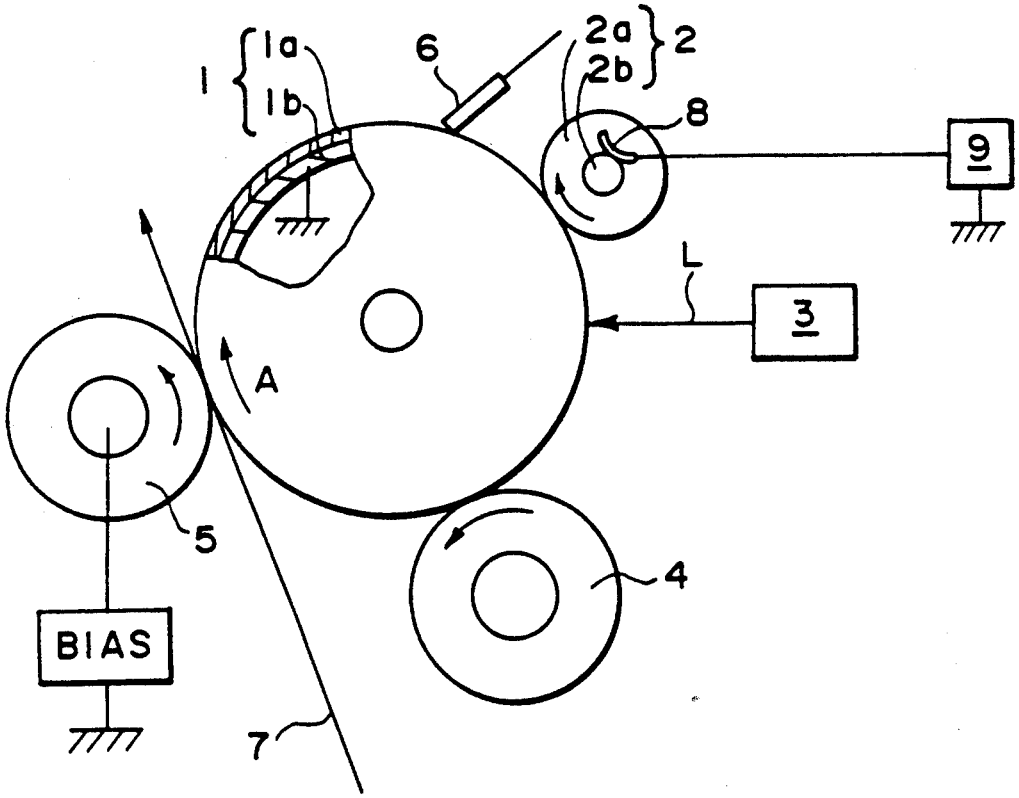
FIG. 1 shows a general arrangement of an exemplary image forming apparatus in the form of a laser beam printer according to an embodiment of the present invention.

Referring to FIG. 1, there is shown an exemplary image forming apparatus according to an embodiment of the present invention. The image forming apparatus is a laser beam printer using an electrophotographic process wherein a contact type charger is used to charge an image bearing member 1.

The image bearing member is an electrophotographic photosensitive member (photosensitive drum) in the form of a rotatable drum. In this embodiment, it comprises an aluminum base drum 1*b* coated with a photosensitive layer of organic photoconductor (OPC) 1*a*. The outer diameter thereof is 30 mm and is rotated at a predetermined process speed Vp (peripheral speed) in the clockwise direction A. As shown in the Figure, the drum base 1*b* is electrically grounded.

Figure 4:
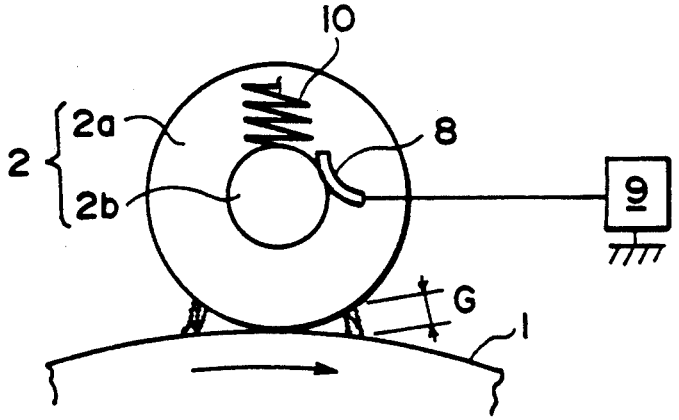
FIG. 4 is a sectional view of another example of a contact charging roller.

A contact type charging member 2 is in the form of a charging roller and comprises a core metal 2*b* covered with conductive roller 2*a* having elasticity and made of carbon-dispersed EPDM or urethane or the like. Similarly to the case of FIG. 4, the opposite end portions of the core metal shaft 2*b* are urged by urging springs toward the photosensitive drum 1 surface to press-contact the charging member thereto. The charging roller rotates following rotation of the photosensitive drum 1. The charging roller 2 is provided with a resistance layer on the conductive roller 2*a* to prevent leakage to the photosensitive drum 1, the resistance layer being made of epichlorohydrin rubber having a larger volume resistivity than the conductive roller 2*a*, and further, the resistance layer is coated with resin layer to prevent softening agent contained in the rubber, the resin layer being made of N methoxy methyl nylon. Although, these layers are not shown in the Figure, but it is preferable that they are provided.

The charging roller 2 is supplied by way of the contact leaf spring 8 with a vibratory voltage, that is, a DC biased AC voltage having a frequency f (Vdc+Vac) to form an alternating electric field between the charging roller 2 and the photosensitive drum 1, by which the surface of the rotating photosensitive drum 1 is uniformly charged to a predetermined negative potential.

A laser beam scanner 3 is supplied with time series electric digital signals corresponding to picture elements representing an intended image from a host apparatus (not shown) such as a computer, a wordprocessor or an image reader. It emits a laser beam L imagewisely modulated at a predetermined printing density D (dpi) in accordance with the digital picture element signal. The surface of the photosensitive drum 1 electrically charged in the manner described above, is exposed to the laser beam L from the scanner 3 controlled by the controller, so that the drum is scanned by the laser beam L in the main scan direction, that is, in the direction parallel to the generating line of the photosensitive drum. By repeating this, an electrostatic latent image corresponding to the intended image information is formed on the photosensitive drum 1 surface.

The latent image is developed by a developing sleeve 4 of the developing device, more particularly, the portion of the photosensitive drum 1 having been exposed to the laser beam L receives negatively charged toner. The developed image is transferred onto a transfer material 7 made of paper and introduced from an unshown sheet feeding station at a proper timing with the developed image to an image transfer station where the photosensitive drum 1 and the transfer roller 5 supplied with a positive DC voltage are contacted or faced.

The transfer material 7 having passed through the transfer station is separated from the photosensitive drum and is conveyed to an unshown image fixing station.

The surface of the photosensitive drum 1, from which the image has been transferred, is cleaned by a cleaning blade 6, so that the residual toner or other contamination matter is removed to be prepared for the next image forming operation.

Figure 8A:
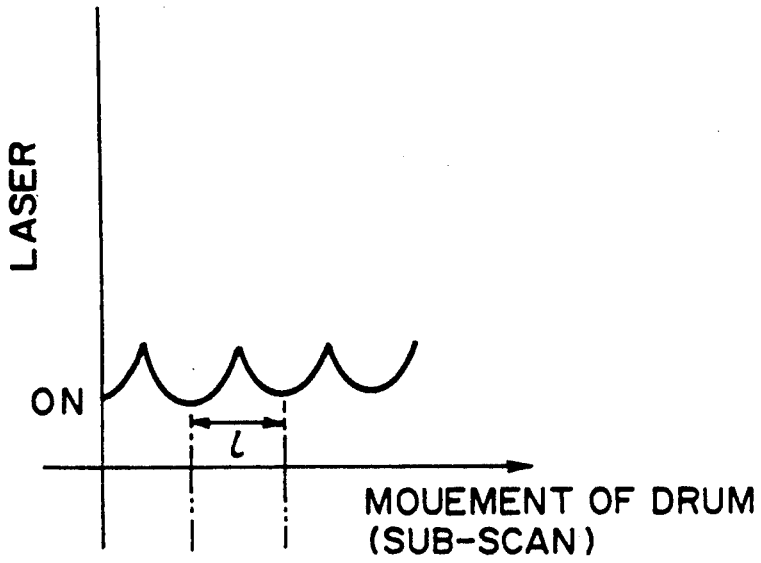
Figure 8B:
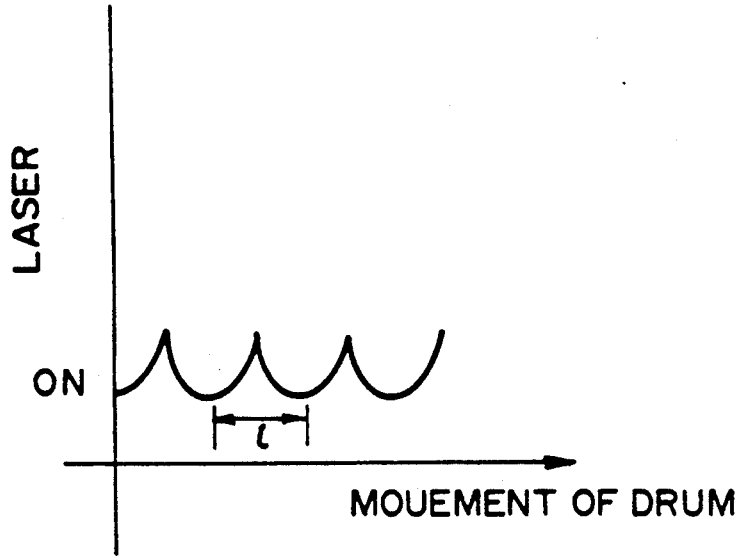
Figure 8C:
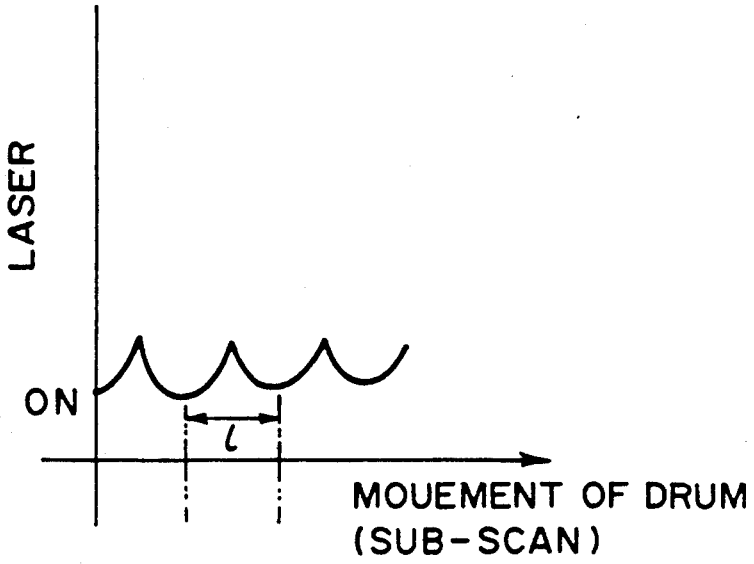

Referring to FIGS. 8A, 8B and 8C, the cause of production of the interference stripes 11*b* shown in FIG. 5 will be described. FIGS. 8A, 8B and 8C show the projections of the laser beam on the moving photosensitive drum. In FIGS. 8A and 8B, the intervals between adjacent scanning lines are indicated by l. The laser beam emitted from the laser scanner is reflected by one of rotating polygonal mirror surfaces to line scan once the photosensitive drum in the main scan direction. The printing density by the laser scanning line is assumed as being 200 dpi (dot per inch). Then, the one dot diameter d is $$d = 25.4 \times 1000/200 = 127.0 \text{ microns.}$$

That is, the interval l between the adjacent scanning lines is $l = d = 127.0$ microns.

Figure 9A:
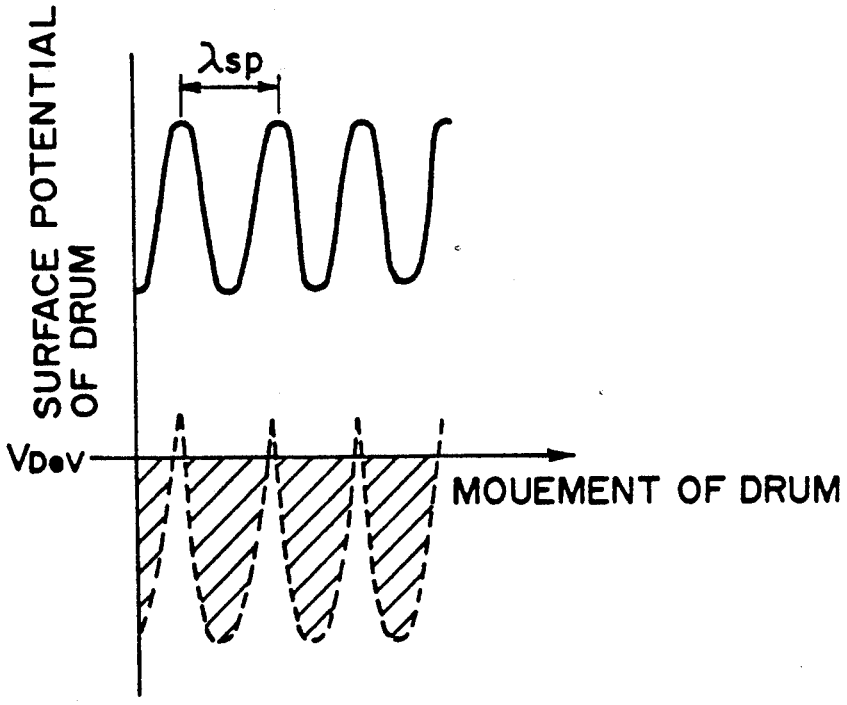

As shown in FIG. 9A in the solid line, in the contact type charging, the dark portion potential VD on the photosensitive drum has a charge pattern which is called "cycle pattern" having a spatial wavelength λsp (=Vp/f) determined by the frequency f of the AC component of the voltage applied by the voltage source 9 and the process speed Vp (the peripheral speed of the photosensitive drum).

The spatial wavelength λsp of the cycle pattern varies more or less depending on the variation of the frequency and the variation in the process speed. It can be measured in the following manner. First, the photosensitive drum is uniformly charged by the charging roller, and then, is exposed to uniform light at its whole surface. The amount of exposure is adjusted so that the cycle pattern on the photosensitive drum is clearly developed.

Subsequently, the developed cycle pattern is transferred and fixed on the transfer sheet. The cycle pattern on the transfer sheet is measured using a magnifier, so that the variations of the spatial wavelength λsp is measured. The cycle pattern becomes smaller with increase of the frequency f of the AC component of the voltage source 9. If it is equal to or larger than several thousand hertz, for example, the pattern is hardly observable by human eyes. However, if the frequency f is higher than 600 Hz, the charging roller mechanically vibrates relative to the photosensitive drum, with the result of noise, and therefore, the frequency f is preferably not more than 600 Hz.

FIG. 9A is a graph of the surface potential of the photosensitive drum vs. positions of the moving photosensitive drum surface.

When the process speed $Vp=12\pi$ mm/sec, and $f=300$ Hz, then $\lambda sp=125.6$ microns.

Then, the spatial wavelength $\lambda sp=125.6$ microns is quite close to $l=127.0$ microns. If they become equal to each other due to the variation in the voltage of the voltage source, the falling of the potential across the developing bias VDev, as shown in FIG. 9A by broken lines, and therefore, lines are developed thick, as shown in FIG. 9A by hatched lines with the result of interference stripes.

The surface of the charging roller is contaminated with foreign matter such as toner particles, silica particles, paper dust or the like, and if this occurs, the contamination portion has come to have electrostatic capacity.

Therefore, even if the same voltage is applied to the core metal **2*b* of the charging roller by the same voltage source 9, the surface potential induced on the photosensitive drum 1** is deviated in the phase at the position where the surface of the charging roller has the electrostatic capacity.

Figure 5:
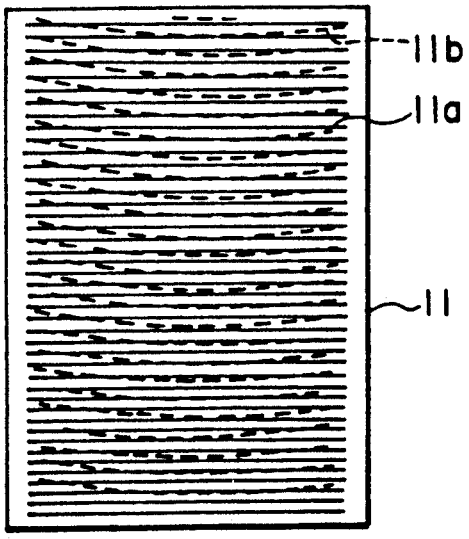
FIG. 5 shows an example of interference stripes.

If the electrostatic capacity is not uniform along the axis of the charging roller with the result of deviated phase, the interference stripes **11*b* may occur as shown in FIG. 5**.

Figure 9B:
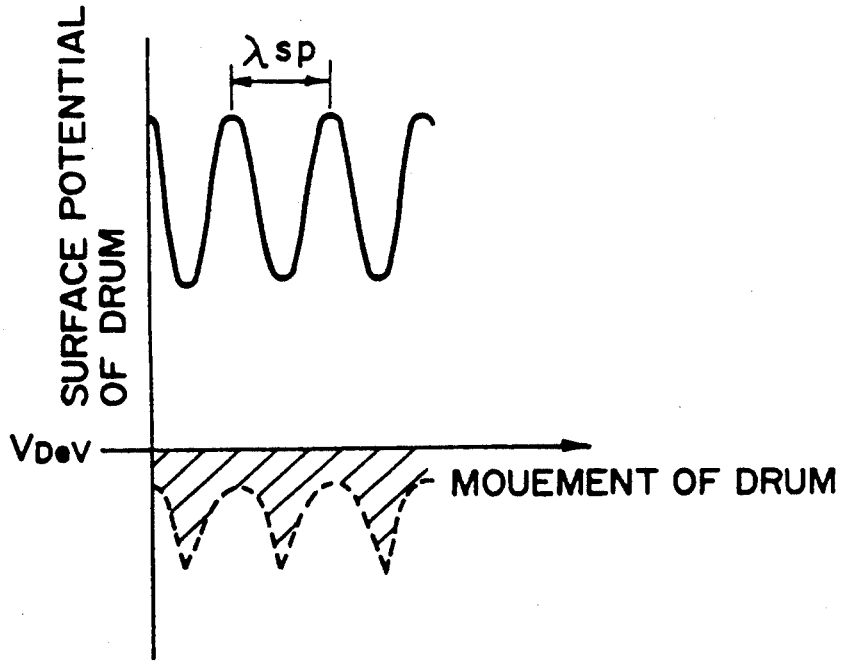

If the phase of the charging potential is deviated from that of FIG. 9A by the amount of half wavelength, for example, that is, if the interval l between adjacent scanning lines and the phase of the spatial wavelength λsp are deviated, the whole surface of the photosensitive drum receives the toner with the developing bias of VDev, as shown in FIGS. 8B and 10B. Thus, the interference stripes appear as shown in FIG. 9A, or do not appear as in FIG. 9B, depending on the difference of the foreign matter (difference in the electrostatic capacity) along the length of the charging roller.

Figure 9C:
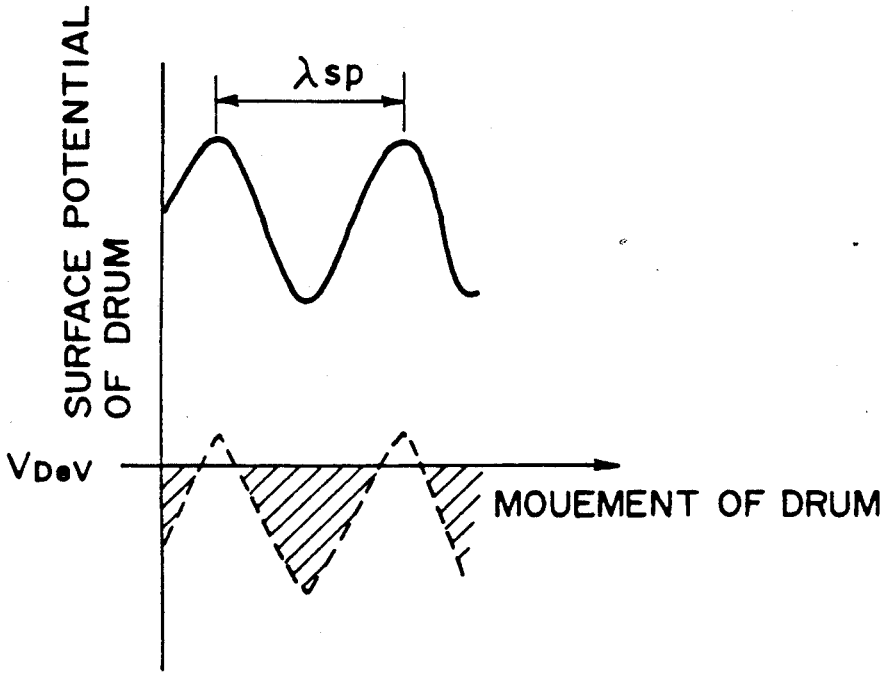

It will be understood that even if the spatial wavelength and the interval between the scanning lines are not the same, the interference stripes are produced depending on the developing bias level if the spatial wavelength is an integer multiple (double in FIG. 9C) or an integer reciprocal of the interval between adjacent scanning lines.

The spatial wavelength λsp is not determined only on the frequency f of the voltage source, but is dependent on the process speed Vp, and therefore, the variation in the process speed Vp is considered similarly as the variation in the spatial wavelength λsp as discussed above.

The production of the interference stripes will be prevented if the frequency and the process speed Vp are so determined that the scanning line interval l does not fall in the variation range of the spatial wavelength λsp determined by the frequency f of the voltage source and the process speed Vp. More particularly, the interference stripes can be prevented if an integer multiple of the scanning line interval or an integer reciprocal thereof is not in the variation range of the spatial wavelength λsp (=process speed divided by the frequency of the voltage source).

Since the interval l between the adjacent scanning lines is the diameter of one dot, as described hereinbefore, the condition of not producing the interference stripes is that the variation range of the wavelengths λsp does not contain an integer multiple or a reciprocal of an integer multiple of the diameter d.

In the laser beam printer, the frequency f of the vibratory voltage provided by the voltage source 9, and the process speed Vp are so determined that the range of the spatial wavelength λsp with its variation and the interval l between adjacent scanning lines multiplied by n or 1/n (n: integer) are not overlapped.

Then, the interference stripes attributable to the interference between the spatial wavelength λsp and the scanning line interval, can be prevented.

The laser beam printer described above is capable of forming line images of various patterns. In the following embodiment, the interference stripes are prevented from occurring in any line image patterns.

In the laser beam printer, various pattern of line images can be formed. In other words, assuming that n dot(s) of image portion continues in the sub-scan direction of the image bearing member (photosensitive drum) and that m dot(s) of non-image portion continues in the sub-scan direction, the laser beam printer is adjustable so that the numbers n and m are arbitrary.

Figure 6A:
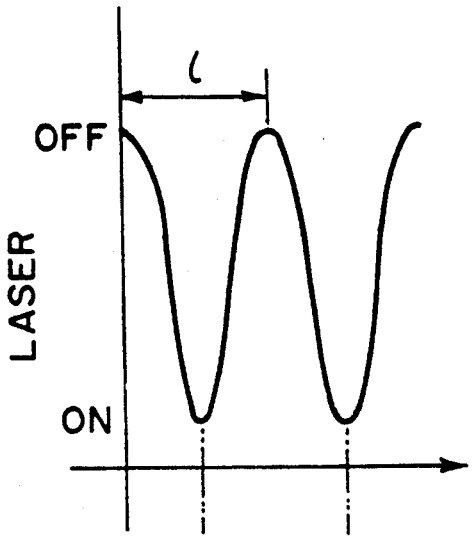
FIGS. 6A, 6B, 7A, 7B, 8A, 8B, 8C, 9A, 9B and 9C are graphs explaining causes of interference stripe production.

FIG. 6A shows an example of on and off of the laser beam. It is a graph of laser on/off vs. the position on the moving image bearing member. During the laser beam being on, the laser beam scans one line on the surface of the photosensitive drum in the main scan detection by one reflecting surface of the rotating polygonal mirror.

The interval between the center of the off state and the center of the next off state of the laser beam in the sub-scan direction of the photosensitive member is given by equation (1) below, if the printed pattern is such a horizontal line pattern **11*a*** wherein the lines each have a thickness of 1 dot spaced with the spaces each corresponds to 1 dot ($n=m=1$) and if the printing density is 40 dpi (dot per inch):

$$d=25.4\times 1000/400=63.5 \text{ microns},$$

the interval $=2\times 63.5$ microns.

For the horizontal line pattern with n dots and m spaces, the interval is:

$$(n+m)d \qquad (1)$$

if $n=m=1$, the interval is 127.0 microns.

Here, "n dots and m species" means that the laser beam scans (on) n lines, and thereafter the laser does not scan (off) m lines, and these operations are repeated.

The contact charging, as contrasted to corona charging, the charge distance G (FIG. 4) is very short, more particularly, as short as approximately 30 microns, and therefore, the charging action is easily influenced by the voltage source 9. In other words, the dark portion potential VD on the photosensitive drum, as shown in FIG. 7A by solid lines, it involves charging pattern called "cycle pattern" having a spatial wavelength λsp (=Vp/f) determined by the frequency f of the AC component of the applied voltage from the voltage source 9 and the process speed Vp (the surface movement speed of the photosensitive drum).

The spatial wavelength λsp of the cycle pattern varies slightly because of the variations in the frequency and the process speed. The range of the variation can be determined by observing the cycle pattern formed on a transfer sheet, in the manner described in the foregoing.

Figure 7A:
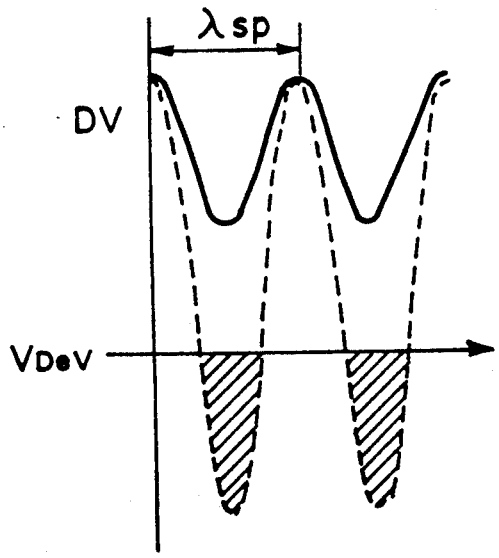

FIG. 7A is a graph of the surface potential of the photosensitive drum vs. position of the moving surface of the photosensitive drum.

If the process speed Vp is $12\pi$ mm/sec, and f=300 Hz, then λsp=125.6 microns.

Figure 6B:
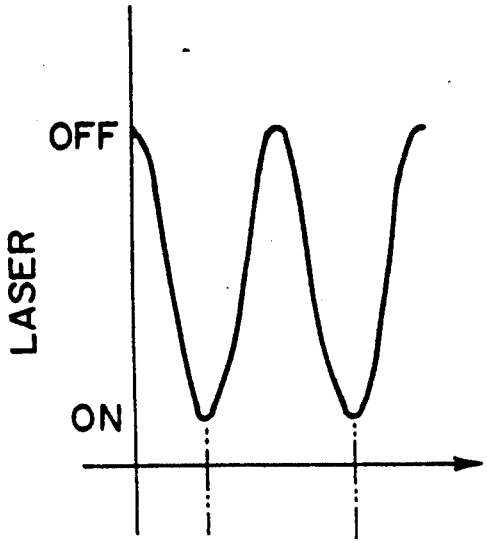
Figure 7B:
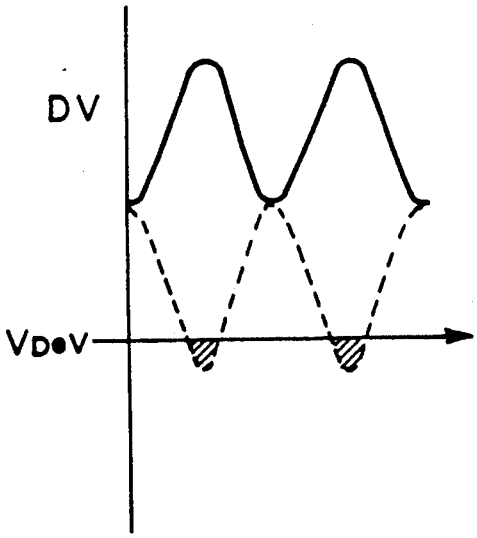

Therefore, the wavelength of the horizontal line pattern given by the equation (1), that is, (n+m)d=127.0 microns becomes quite close to the spatial wavelength λsp=125.6 microns. When the phases thereof becomes the same, the falling of the potential across the developing bias VDep becomes large as shown in FIG. 7A, with the result that the lines are developed thick, and therefore, interference stripes are produced. On the contrary, the phase difference between the wavelength of (n+m)d and the spatial wavelength λsp is the half wavelength, as shown in FIGS. 6B and 7B, the lines are developed thin, and the interference stripes are produced.

In use of the charging roller 2, foreign matter such as toner particles, silica particles or paper dust is deposited on a part of the surface of the roller, with the result that the part thus contaminated as electrostatic capacity.

Therefore, even if the same voltage is applied to the core metal **2*b* of the charging roller from the same voltage source 9, the surface potential induced on the photosensitive drum 1** is different in the phase between the portion having the electrostatic capacity and the portion not having the capacity.

When the phase difference occurs due to the electrostatic capacity difference along the axis of the charging roller results in the production of the interference stripes **11*b*, as shown in FIG. 5**.

Figure 10:
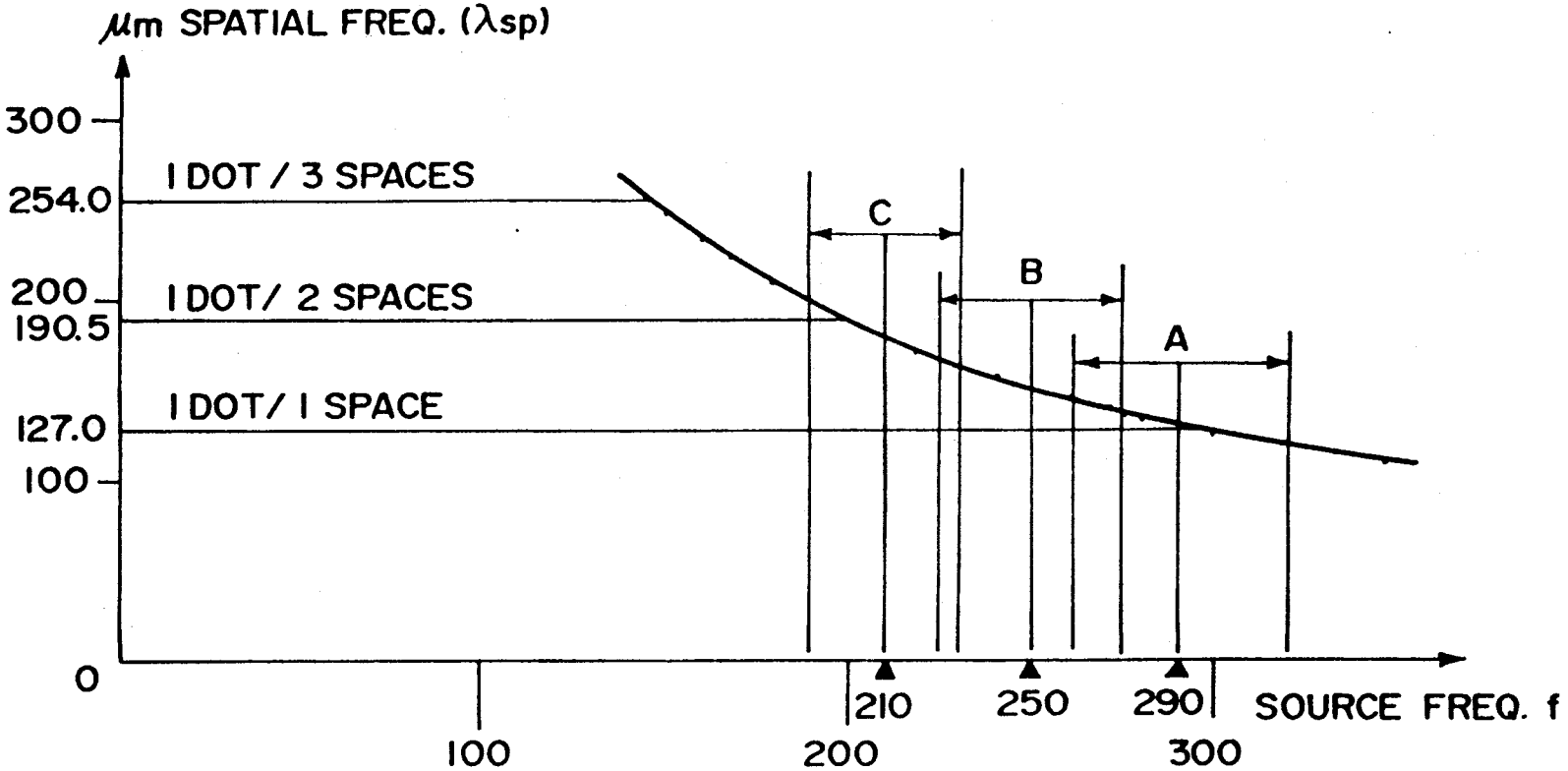
FIG. 10 is a graph of spatial wavelength λsp vs. wavelength number f of the voltage source.

FIG. 10 is a graph of a spatial wavelength λsp vs. voltage source frequency f under the condition that the process speed Vp is $12\pi$ mm/sec, and the printing density is 400 dpi. In this case, (n+m)d of the horizontal line pattern with one dot and one space is 127.0 microns; (n+m)d of the horizontal line pattern with 1 dot and 2 spaces is 190.5 microns; and (n+m)d of the horizontal line pattern with 1 dot and 3 spaces is 254.0 microns.

The rated frequency of the voltage source was 290 Hz, and the variation of the frequency due to the accuracy of the parts or the like was 10%, that is, the frequency was 290±10%, more particularly, the frequency ranges from 261–319 Hz. The range is indicated by A in FIG. 10. As a result, even if the process speed Vp=$12\pi$ mm/sec is constant, the spatial wavelength λsp ranges from 118–114 microns. Therefore, the wavelength (n+m)d of the horizontal line pattern with 1 dot and 1 space, that is, 127 microns may fall in the range. Then, an integer multiple (one) of (n+m)d may be equal to the spatial wavelength in the range, and therefore, the likelihood of the interference stripe **11*b*** production is high.

When the frequency f of the voltage source is set to be 250 Hz, the actual frequency ranges from 250 Hz+10% to 250 Hz-10% (225–275 Hz, as shown in FIG. 10 by B. If the process speed Vp (=$12\pi$ mm/sec) is constant, the spatial wavelength changes within the range from 137–168 microns. In this case, any of the horizontal line patterns with 1 dot and 1 space, with 1 dot and 2 spaces or with 1 dot and 3 spaces do not result in that (n+m)d multiplied by N or by 1/N (N: integer) falls in the variable range of the spatial wavelength. This applies to any integers of n and m. In other words, it applies to any case where the laser beam printer produces any horizontal line patterns Accordingly, the interference stripes are not produced when the frequency f of the voltage source and the process speed Vp are set in the manner described above.

When the frequency f of the voltage source is 210 Hz, the frequency is in the range of 210 Hz±10%, as indicated by a reference C in Fig. 10 (189–231 Hz). When the process speed Vp (=$12\pi$ mm/sec) is constant, the spatial wavelength varies from 163–199 microns. When the horizontal line pattern with 1 dot and 2 spaces is formed, it is probable that (n+m)d=190.5 microns falls in the variable range of the spatial wavelength. Therefore, when the frequency f and the process speed Vp are set in this manner, the likelihood of the interference stripe production is high.

As described in the foregoing, even if the spatial wavelength and (n+m)d are not equal to each other, the interference stripes are produced if the spatial wavelength is an integer multiple or a reciprocal of an integer of (n+m)d.

With respect to FIG. 10, the description has been made on the assumption that the process speed Vp does not vary. However, the spatial wavelength λsp depends not only the voltage source frequency f but also the process speed Vp. Therefore, the same consideration made in the foregoing applies to the variation in the spatial wavelength λsp due to the process speed Vp variation.

As described in the foregoing, by determining the voltage source frequency f and the process speed Vp such that the wavelength (n+m)d of the horizontal line pattern does not follow in the variable range of the spatial wavelength λsp determined by the voltage source frequency f and the process speed, the production of the interference stripes can be prevented. In other words, an integer multiple or a reciprocal of an integer of (n+m)d does not follow in the variable range of the spatial wavelength λsp, the process speed multiplied by the frequency of the voltage source, by which the interference stripe production can be related for any horizontal line pattern, that is, for any n and m (n,m: integers).

From the above equation (1), it is understood that the wavelength of the horizontal line pattern is an integer of the diameter of dot, and therefore, the non-interference-stripe condition is satisfied if the variable range of λsp does not contain an integer multiple of the dot diameter of a reciprocal of an integer multiplied by the dot diameter.

In the laser beam printer, the ranges for the frequency f of the AC component of the voltage source 9 and the process speed Vp is set such that the variable range of the spatial wavelength λsp does not overlap the range of (n+m)d.

By doing so, the interference stripes resulting from the overlapping between the spatial wavelength λsp and the wavelength of the horizontal line pattern can be removed for any of horizontal line patterns.

Figure 2:
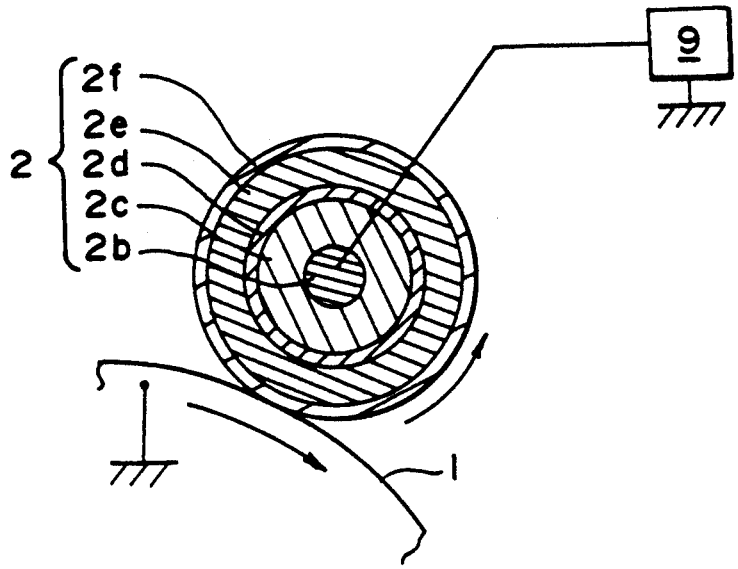
FIG. 2 is a sectional view of an example of a multilayered charging roller.

The member to be charged by the charging roller 2 might have a defect such as pin hole or the like. If such a member is charged, using the charging roller 2, it is possible that unusual electric discharge occurs such as electric current leakage. In order to avoid this, the surface of the charging roller is coated with protection layer, as described hereinbefore. p FIG. 2 shows an example of such a charging roller. It comprises a core metal 2*b*, a low resistance layer may be EPDM or urethane rubber in which carbon is dispersed, a conductive layer 2*d* made of N methoxy methyl nylon or Torezin (trade name) in which large amount of carbon is dispersed, a high resistance layer 2*e* made of epichlorohydrin rubber or the like, and a protection layer 2*f* of Torezin. The same effects can be provided, when such a charging roller 2 is used.

The contact type charging member is not limited to the roller type, but may be in the form of a blade, a rod, a block, a pad, a belt, a web, a brush or the like.

Figure 3:
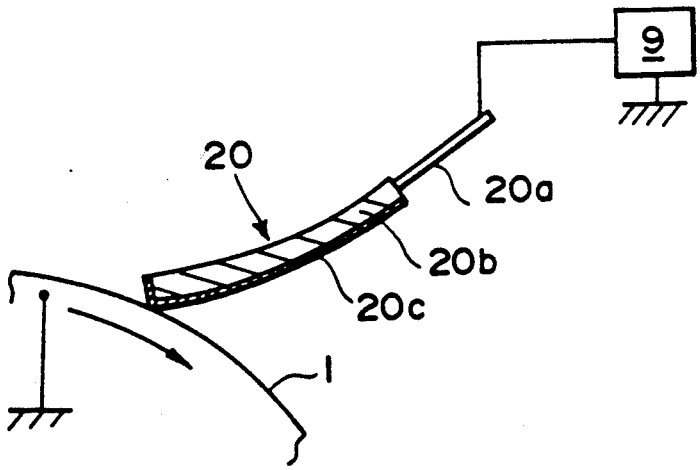
FIG. 3 is a sectional view of an example of a charging blade.

FIG. 3 shows an example of a blade type charging member 20 (charging blade). It comprises a sheet metal for applying a bias voltage to the blade, a blade body having a low resistance made of EPDM in which carbon is dispersed, and a high resistance layer 20*c* of epichlorohydrin rubber.

In this example, the edge of the charging blade 20 is press-contacted to the photosensitive drum 1 counter directionally with respect to movement direction of the surface of the photosensitive drum 1 with a predetermined pressure.

The same results can be obtained with such a charging blade 20, by selecting the frequency f of the voltage source and the process speed Vp in the manner described above.

The charging blade 20 has an advantage over the charging roller in that the cost is low, and the required space is small.

The foregoing description has been made with respect to the case wherein the image bearing member in the form of a photosensitive member is charged by the contact type charging member, and is exposed to the laser beam which is deflected by a rotating polygonal mirror in the longitudinal direction of the image bearing member (generating line of the photosensitive drum) to form a latent image along the scanning line. However, the present invention is not limited to this, but is applicable to the case wherein an LED head having LED elements arranged along a length of the photosensitive member is faced to the photosensitive member, and the LED are selectively actuated by signals from controller to form a latent image along the scanning line of the group of the LED element.

The image bearing member is not limited to the photosensitive member but may be an insulating member. In this case, a multi-stylus recording head may be used which has electrode pins arranged along the length of the image bearing member and faced thereto downstream of the contact charging member with respect to movement detection of the image bearing member. The latent image is formed along the line of the multi-stylus pins after the insulating member is electrically charged.

The present invention is applicable not only to the reverse-development type described in the foregoing, but is usable to a regular development type.

The vibratory voltage applied between the image bearing member and the contact type charging member may be a sine wave, rectangular wave or triangular wave.

As described in the foregoing, according to the present invention, the frequency of the vibratory voltage applied between the contact type charging member and the image bearing member and the moving speed of the image bearing member are selected in the ranges described in the foregoing, by which the interference stripes appearing on the output image can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

charging means for charging said image bearing member while it is moving, said charging means including a contact member contactable to said image bearing member and voltage application means for applying a vibratory voltage between said contact member and said image bearing member;

latent image forming means for forming a latent image along a scanning line on said image bearing member charged by said charging means, the latent image being developed and transferred onto a transfer material, wherein a frequency f of the vibratory voltage and a speed Vp of the movement of said image bearing member are so selected that an interval between adjacent scanning lines multiplied by N or 1/N does not fall within a variation range of a spatial wavelength $\lambda sp$ where $\lambda sp = Vp/f$.

2. An apparatus according to claim 1, wherein a waveform of said vibratory voltage is a sine waveform.

3. An apparatus according to claim 1, wherein said vibratory voltage is a DC biased AC voltage.

4. An apparatus according to claim 1, wherein said contact member is in the form of a roller.

5. An apparatus according to claim 1, wherein said contact member is in the form of a blade.

6. An apparatus according to claim 1, wherein said latent image forming means forms a latent image on said image bearing member in accordance with image signals corresponding to image information.

7. An apparatus according to claim 6, wherein said image bearing member is a photosensitive member, and said latent image forming means includes a laser scanner for exposing said photosensitive member in accordance with image signal corresponding to the image information.

8. An apparatus according to claim 1, wherein the movement speed Vp is the movement speed of said image bearing member while it is being charged.

9. An apparatus according to claim 1, wherein the frequency f of the vibratory voltage does not exceed 600 Hz.

10. An apparatus according to claim 1, wherein said contact member comprises a conductive layer and a resistance layer having a resistance larger than that of the conductive layer at a side which is closer to said image bearing member than said conductive layer.

11. An image forming apparatus, comprising:

a movable image bearing member;

charging means for charging said image bearing member, said charging means including a contact member contactable to said image bearing member and voltage applying means for applying a vibratory voltage between the contact member and said image bearing member;

latent image forming means for forming a latent image along a scanning line on said image bearing member charged by said charging means, the latent image being developed and transferred onto a transfer material;

wherein a frequency f of the vibratory voltage and a speed Vp of the movement of said image bearing member are so selected that a variation range of a spatial wavelength $\lambda sp = Vp/f$ does not overlap the result of $(n+m)d$ multiplied by N or 1/N, where n is the number of scanned lines, m is the number of non-scanned lines, and d is a diameter of one dot of the image.

12. An apparatus according to claim 11, wherein a waveform of said vibratory voltage is a sine waveform.

13. An apparatus according to claim 11, wherein said vibratory voltage is a DC biased AC voltage.

14. An apparatus according to claim 11, wherein said contact member is in the form of a roller.

15. An apparatus according to claim 11, wherein said contact member is in the form of a blade.

16. An apparatus according to claim 11, wherein said latent image forming means forms a latent image on said image bearing member in accordance with image signals corresponding to image information.

17. An apparatus according to claim 16, wherein said image bearing member is a photosensitive member, and said latent image forming means includes a laser scanner for exposing said photosensitive member in accordance with image signals corresponding to image information.

18. An apparatus according to claim 11, wherein the movement speed Vp is the movement speed of said image bearing member while it is being charged.

19. An apparatus according to claim 11, wherein the frequency f of the vibratory voltage does not exceed 600 Hz.

20. An apparatus according to claim 11, wherein said contact member comprises a conductive layer and a resistance layer having a resistance larger than that of the conductive layer at a side which is closer to said image bearing member than said conductive layer.

* * * * *